US011879331B2

(12) United States Patent
Anischenko

(10) Patent No.: US 11,879,331 B2
(45) Date of Patent: Jan. 23, 2024

(54) VIBRO-ANCHORING SYSTEM INTEGRATED INTO HORIZONTAL DIRECTIONAL RIG

(71) Applicant: Vasily Anischenko, Lake Zurich, IL (US)

(72) Inventor: Vasily Anischenko, Lake Zurich, IL (US)

(73) Assignee: UNIVERSAL HORIZONTAL DIRECTIONAL, Lake Zurich, IL (US)

( * ) Notice: Subject to any disclaimer, the term of this patent is extended or adjusted under 35 U.S.C. 154(b) by 0 days.

(21) Appl. No.: 17/845,298

(22) Filed: Jun. 21, 2022

(65) Prior Publication Data

US 2022/0403702 A1 Dec. 22, 2022

Related U.S. Application Data

(60) Provisional application No. 63/212,904, filed on Jun. 21, 2021.

(51) Int. Cl.

| | |
|---|---|
| ***E21B 15/00*** | (2006.01) |
| ***E21B 7/02*** | (2006.01) |
| ***E21B 7/24*** | (2006.01) |
| ***E21B 7/04*** | (2006.01) |

(52) U.S. Cl.
CPC ..... *E21B 7/024* (2013.01); *E21B 7/046* (2013.01); *E21B 7/24* (2013.01); *E21B 15/006* (2013.01)

(58) Field of Classification Search
CPC ..... E21B 15/006; E21B 7/024; E21B 7/046; E02D 7/18
See application file for complete search history.

(56) References Cited

U.S. PATENT DOCUMENTS 3,903,973 A * 9/1975 Leyrat ..... E21B 3/02 173/218
2020/0199940 A1* 6/2020 Auer ..... E21B 7/024

* cited by examiner

*Primary Examiner* — Giovanna Wright
(74) *Attorney, Agent, or Firm* — Justin Lampel

(57) ABSTRACT

An anchoring device for a horizontal directional rig is provided. The anchoring device uses vibrations from a motor to drive an anchor into the ground in a more efficient manner than traditional stake down systems. The vibrating motor is mounted to a stake down carriage. The oscillations from the motor allow the steel anchor to penetrate the ground with a small axial load and therein allows greater surface and holding force.

6 Claims, 3 Drawing Sheets

VIBRO-ANCHORING SYSTEM INTEGRATED INTO HORIZONTAL DIRECTIONAL RIG

REFERENCE TO RELATED APPLICATIONS

This application is based on and claims priority to U.S. Provisional Application No. 62/212,904 which was filed on Jun. 21, 2021, the entire contents of which are incorporated by reference herein.

BACKGROUND OF THE INVENTION

An anchoring device for a horizontal directional rig is provided. The anchoring device uses vibrations from a motor to drive an anchor into the ground in a more efficient manner than traditional stake down systems. The vibrating motor is mounted to a stake down carriage. The oscillations from the motor allow the steel anchor to penetrate the ground with a small axial load and therein allows greater surface and holding force.

The present invention relates generally to underground drilling machines. More particularly, the present invention relates to systems or methods for anchoring underground drilling machines on the ground. The purpose of all existing anchoring systems is to prevent the horizontal directional drilling rig from axial movement resulting from drilling operations or pipe pull in.

Horizontal directional drilling is used for trenchless installation of communication lines and pipelines under natural and artificial obstacles like rivers or roads. The trenchless installation process is carried out in several stages: pilot bore, reaming, cleaning, and pipe pull in. All the above-mentioned operations are accomplished with the help of a horizontal directional drilling rig. The technology demands that all directional drilling rigs should be anchored to the ground to prevent them from axial movement caused by substantial forces applied to a string of drill rods or casings.

Anchoring systems for rigs are common. For example, U.S. Pat. No. 10,689,930 to Crabb discloses a dual-action hydraulically operable anchor having a hydraulic anchor body for positioning a whipstock in a wellbore. A split clamp retains an upper sub and the hydraulic anchor body. A lower cap guides the hydraulic anchor within the wellbore. The floating mandrel transmits a hydraulic fluid into the fixed housing, transmitting compressive force from the upper hydraulic piston or from mechanical force applied to the whipstock above and adjoining the hydraulic anchor. The lower hydraulic piston operates along the floating mandrel using transmitted hydraulic fluid. A T-slot adapter and a slip move from a flush position along the fixed housing to an extended position along the fixed housing such that the slip firmly engages the wellbore to hold the hydraulic anchor and the whipstock in a fixed position for providing a path for lateral drilling outside the wellbore.

Further, U.S. Pat. No. 8,919,431 to Lou discloses a hydraulic wellbore anchoring system for use with whipstocks or other tools in either cased or open hole wellbores. The anchoring system includes an upper slip system and a lower slip system. The anchor system may be set using hydraulic pressure and withdrawn by a predetermined upward force. While the slips of the upper and lower slip systems may be set substantially simultaneously, the anchoring system enables sequential disengagement of the slips to reduce the force required for withdrawal.

Still further, U.S. Pat. No. 10,329,861 to Weckend discloses a system and methods for engaging and disengaging running tools with a liner in a downhole system are described herein. The system and methods include a liner disposed in a borehole, the liner having at least one running tool engagement section, a running tool disposed within the liner, the running tool having at least one engagement module that is operable from a disengaged position to an engaged position and that is operable from an engaged position to a disengaged position, and an electronic device disposed at least one of in or on the engagement module.

However, these patents fail to describe an anchoring device for a horizontal directional rig which is easy to use. Further, these patents fail to provide for an anchoring device for a horizontal directional rig which utilizes a vibrating motor to drive an anchor into the ground.

SUMMARY OF THE INVENTION

An anchoring device for a horizontal directional rig is provided. The anchoring device uses vibrations from a motor to drive an anchor into the ground in a more efficient manner than traditional stake down systems. The vibrating motor is mounted to a stake down carriage. The oscillations from the motor allow the steel anchor to penetrate the ground with a small axial load and therein allows greater surface and holding force.

An advantage of the present anchoring device for a horizontal directional rig is that the present anchoring device for a horizontal directional rig allows a steel anchor to penetrate the ground with an extremely small axial load.

Another advantage of the present anchoring device for a horizontal directional rig is that the present anchoring device for a horizontal directional rig allows anchors to sink into the ground with greater surface and holding force than traditional anchoring systems.

For a more complete understanding of the above listed features and advantages of the anchoring device for a horizontal directional rig reference should be made to the detailed description and the drawings. Further, additional features and advantages of the invention are described in, and will be apparent from, the detailed description of the preferred embodiments.

DETAILED DESCRIPTION OF THE PREFERRED EMBODIMENTS

An anchoring device for a horizontal directional rig is provided. The anchoring device uses vibrations from a motor to drive an anchor into the ground in a more efficient manner than traditional stake down systems. The vibrating motor is mounted to a stake down carriage. The oscillations from the motor allow the steel anchor to penetrate the ground with a small axial load and therein allows greater surface and holding force.

Figure 1:
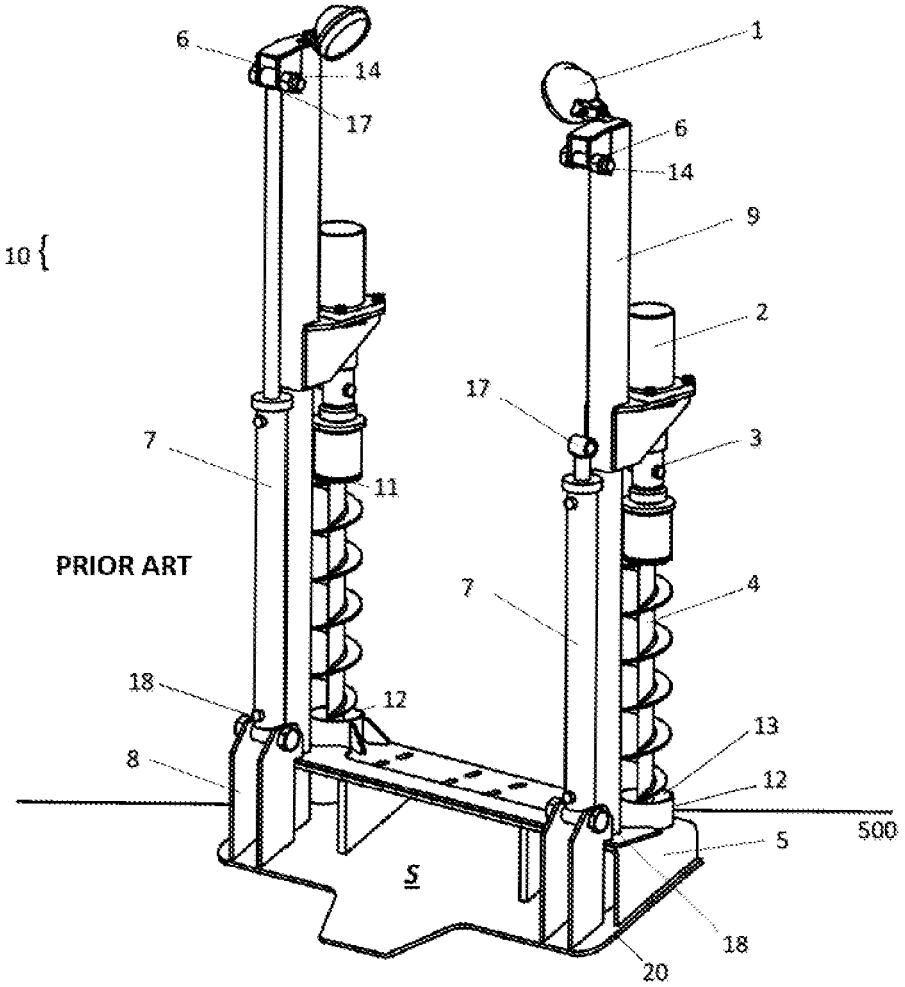
FIG. 1 illustrates a prior art anchoring systems for horizontal drilling rigs having a conventional stake down system for anchoring horizontal directional drilling rigs.

Referring first to FIG. 1, a traditional anchoring machine 10 is shown. The traditional anchoring machine 10 may have a light 1 for lighting the immediate area around the machine 10 while work is performed. A rotary drive 2 of the machine 10 is located above the augers 4 of the machine 10. A coupling device 3 is located between the rotary drive 2 and the augers 4. The augers 4 may have a top 11 and a bottom 12. The bottom 12 of the augers 4 may pass through an opening 13 of a front foot 5 which is located at a bottom 20 of the machine 10.

The rotary drive 2 of the machine 10 rotates the augers 4. Preferably, two rotary drives 2 and two augers 4 are provided per machine 10. Traditional stake down machines 10, like the one illustrated in FIG. 1, have two cylinders 7. The cylinders 7 move the rotary drive 2, the coupling device 3 and the auger 4 as a single unit. The cylinders 7 have a first end 17 and a second end 18. The first end 17 is connected to a pin 14 of an upper bracket 6 and the second end 18 of the cylinder 7 is connected to a pin 14 of a lower bracket 8. FIG. 1 illustrates the upper bracket 6 of the right shaft unconnected to the first end 17 of the right cylinder 7. The pin 14 may be fixed to the bracket assembly 6 and may allow the bracket 6 to move in a sideways movement. Both augers 4 are driven into the ground 500 pushed by the cylinders 7 and rotated by rotary drives 2 attached to the stake down poles 9.

The anchoring system is mounted on the front foot 5. The front foot 5 holds the rig (not shown in FIG. 1) against the ground 500. Further, the front foot 5 distributes the radial forces resulting from the augers 4 rotating while drilling. Axial forces are communicated to the auger (or "anchors") 4 in the ground 500. The front foot 5 of the traditional system shown in FIG. 1 is located at the front of the horizontal directional drilling rig (not shown in FIG. 1). Hydraulic motors 9 are mounted on the two augers and force the augers 4 into the ground 500.

The traditional anchoring system described above with respect to FIG. 1 is not effective in soft alluvial ground when the horizontal directional drilling rig riches its maximum pull or thrust force. For this purpose, most drilling contractors use heavy bulldozers, excavators, or other pieces of heavy equipment to hold the rig in place. The rigs are equipped with pull eyes or chackles at the front and at the back. The pull eyes are used to attach ropes or chains anchoring the rig to a piece of heavy equipment. The low holding capacity of the existing anchors dictates the necessity to invent an anchoring system, which could hold higher axial forces. In cases, when the thrust force of a rig exceeds 100 tons, the machine is anchored to a thrust wall of sheet piles or bored piles. But the thrust wall has never been included into the structure of the drill rig.

Figure 2:
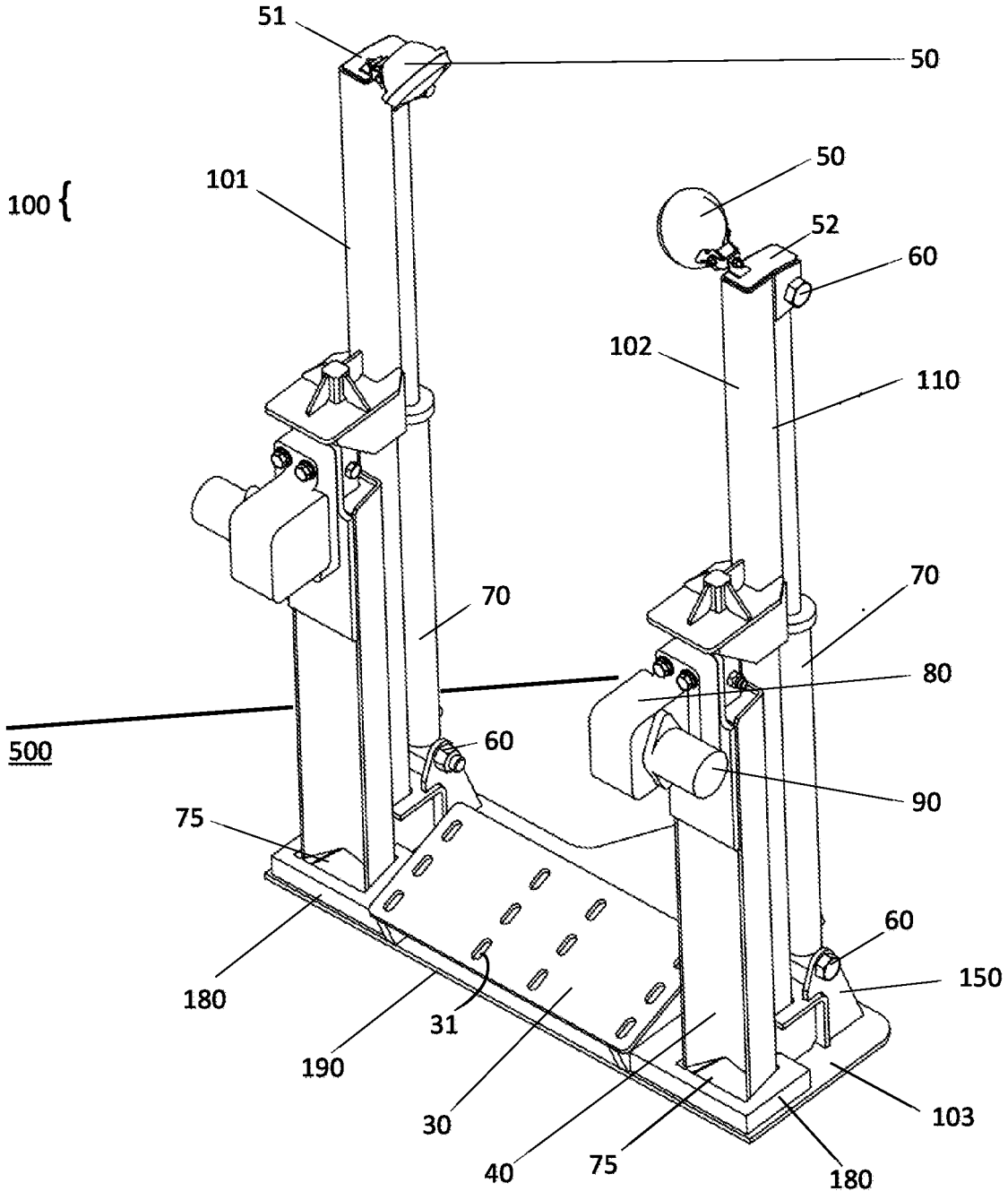
FIG. 2 illustrates one embodiment of the present vibro-anchoring system for a horizontal rig.
Figure 3:
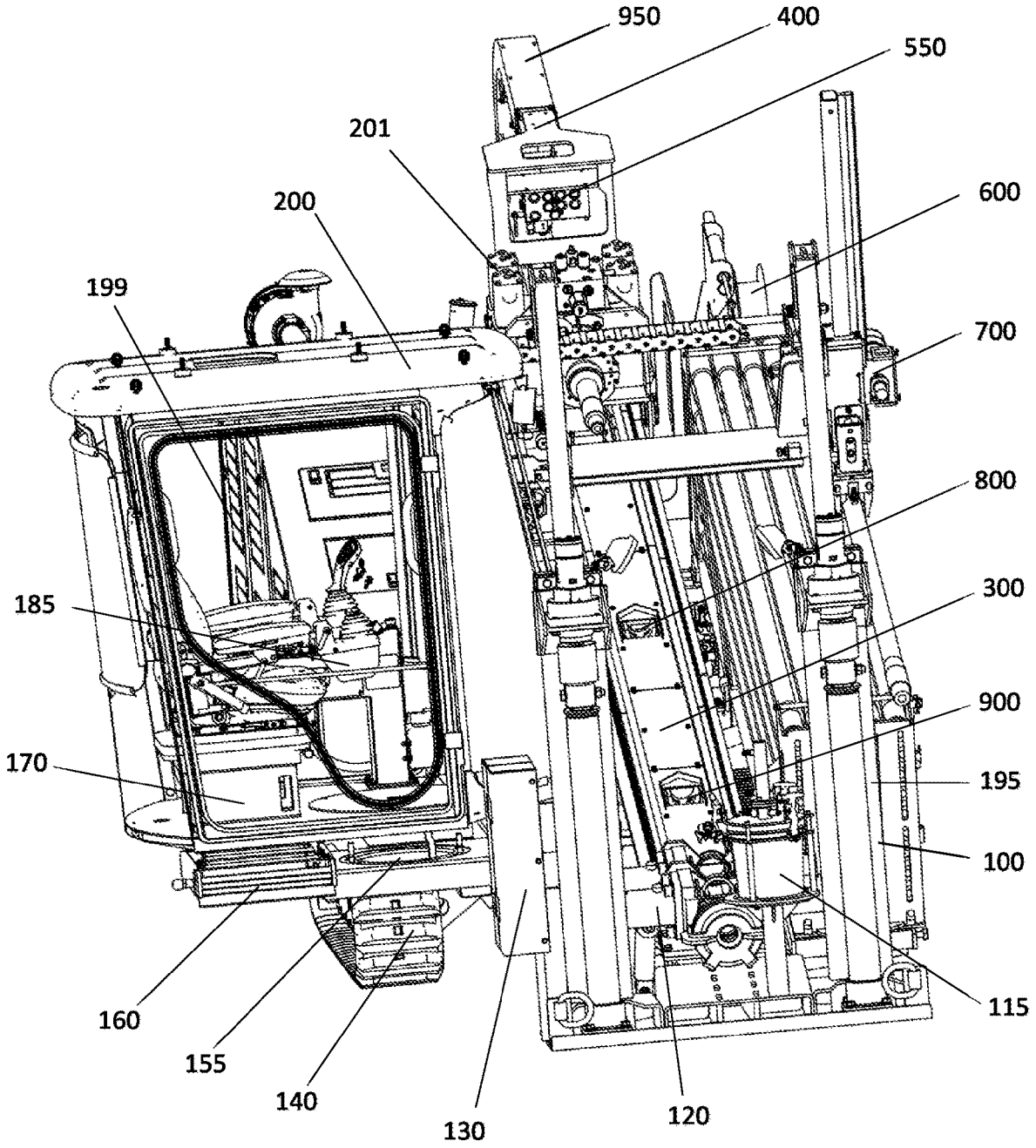
FIG. 3 illustrates a HDD rig with the present anchoring system attached.

Referring now to FIGS. 2 and 3, a novel present and improved system is now shown wherein the system uses a vibro-anchoring machine 100. The present vibro-anchoring machine 100 may have, in the preferred embodiment, a first column unit 101, a second column unit 102 and a base unit 103. The first column unit 101 and the second column unit 102 may be substantially identical, but in a mirror orientation with respect to each other. The bottom of the first column unit 101 and the bottom of the second column unit 102 may both be secured the base unit 103. The base unit 103 may have a top surface and a bottom surface.

Located at the top 51 of the first column unit 101 and located at the top 52 of the second column unit 102 may be a light 50 for illuminating the area around the machine 100. Preferably, there is at least one light 50 on each of two column units 101, 102. Each column unit 101, 102 of the present machine 100 may have cylinder 70.

The cylinders 70 are generally hydraulic cylinders or screw jacks (not shown). The cylinders 70 may be secured by pins 60. In an embodiment, the cylinders 70 may move upward or downward. In particular, for each cylinder 70, a pin 60 may be located at the top 51, 52 of the column unit 101, 102 and the second pin 60 may be located at the bottom of the column units 101, 102 attached to, for example, a bracket 150 of the bottom unit 103.

As each of the hydraulic cylinders 70 force an anchor 40 into the ground 500, the anchors 40 pass through openings 75 of foot guides 180 of the base unit 103 of the machine 100. In particular, not only do the hydraulic powered cylinders 70 force the anchors 40 downward into the ground 500, but, at the very same time, motors 90 connected to a vibrator apparatus 80 of the machine 100 vibrate (or oscillates) the anchors 40 to make the entry of the anchors 40 into the ground 500 quicker and easier. More specifically, as the anchors 40 vibrate, the dirt in the ground 500 becomes loose, allowing the hydraulic powered cylinders 70 to more easily force the anchors 40 into the ground 500. In an embodiment, the present machine 100 may utilize, for example, a pneumatic hammer in addition to, or in place of, the vibrator apparatus 80.

In an embodiment, the bottom unit 103 of the machine 100 may have a break out mounting plate 30. The break out mounting plate 30 is preferably angled with respect to the ground 500. In particular, the break out mounting plate 30 is preferably angled between twenty-five and fifty-five degrees with respect to the ground. The break out plate 30 may have a plurality of holes 31. The plurality of holes 31 may be used to install the break out mechanism at various angles. The mechanism may be used in the drilling process to break out the drilling tool joints after the drilling rig is properly anchored; and is not used for anchoring the rig.

In an embodiment, the bottom unit 103 of the machine 100 may have a plate (or "front foot") 190. The plate 190 makes actual contact with the ground 500 and is parallel to the ground 500, but below the break out plate 30. Further, the break out plate 190 may serve as a support of the front portion of the machine 100.

Referring now to FIG. 3, in an embodiment, the present machine 100 may be connected to a drill rig 950. The drill rig 950 may have a carriage 201 and a cab 200. The carriage 201 may have an engine to move the drill rig 950 and the cab 200 may be the portion of the drill rig 950 that the operator sits in while operating the drill rig 950. A rack 300 may serve as the central part of the drilling rig 950 by guiding the carriage 201. A hose carrier 400 may keep the hoses of the drill rig 950 from accidently falling becoming dislodged during use of the drill rig 950.

In an embodiment, the machine 100 may have a carriage manifold 550. The carriage manifold 550 may serve as a hydraulic switch between the first and the second speed of the carriage 201. A high-pressure washer hose reel 600 may provide a cleaning mechanism for the machine 100 or surrounding items. A rod loader 700 may be present on the side of the machine 100. The rod loader 700 may load the drill rods (round hollow pipes with threaded ends) and drill tools, which are not part of the rig, on the rack 300. The machine 100 may further have a rear rod support 800 and a front rod support 900. The rear rod support 800 and the front rod support 900 may serve as centralizers putting various types of drilling tools in front of the center of the break out 120.

In an embodiment, the machine 100 may have a stake down anchoring mechanism 195. The steak down anchoring mechanism 195 of FIG. 3 may be similar to the steak down anchoring mechanism of FIG. 2. A greasing unit 115 may provide proper grease throughout the system. A breakout unit 120 may serve to disconnect the drilling tool joints, which are not part of the rig, during drilling operations.

In an embodiment, the machine 100 may have a hydraulic control manifold 130 for breakout and steak down functions. In particular, the hydraulic control manifold 130 may control all functions of the break out 120 and the stake down anchoring system 100. In one embodiment, the machine 100 may also be located on tracks 140 which allow the machine 100 to be easily transported from site to site. An opening 155 for a slew drive may be located at or near the bottom of the rig 950 and may allow the slew drive to rotate the cab 200.

In an embodiment, the drilling rig 950 may be equipped with a folding step 160 so that an operator may easily enter the control area of the drilling rig 950. A heater 170 may provide heat to the operator in cold environments. Controls 185 may be located within the cab 200 of the drilling rig 950 to allow the operator to control the drill rig 950 and the actual drill machine 100. An engine compartment 199 may be located near the cab 200.

The present vibro-anchoring mechanism 100 of FIGS. 2 and 3 may better secure the anchors 40 into the ground 500 over traditional drill machines (as shown in FIG. 1) as a result of having at least the below advantages:

Higher surface area projected on the surface perpendicular to the thrust axes increases the anchor's strength proportionally to the increase of the surface area;

Reduced weight of the anchoring structure; and

Better penetration rate when the anchor is being sunk to the ground.

The functioning principle of the present vibro-anchor is described below:

A break out plate 30 is attached to the front foot 5. The break out plate 30 is preferably made of steel. The break out plate 30 is attached to the front of the horizontal directional drilling rig 950. The break out plate 30 may be trapezoid or produced out of steel C-profile.

The present machine 100 is equipped with a hydraulic vibration motor 80,90, which drives the vibro-anchor 40 into the ground 500. The oscillations are generated by vibrator 80 driven by the vibration motor 90. The vibrator communicates its vibrations to the anchoring plates 40, which allows the anchoring plates 40 to penetrate the ground 500 with extremely small axial load, which allows the anchoring plates 40 to be secured in the ground 500 with greater surface and holding force.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

I claim:

1. A anchoring system for a horizontal rig comprising:

a base unit having a top surface and a bottom surface;

a first column unit;

a second column unit;

a non-cylindrical anchor having a vertical shaft incorporated into at least the first column unit or the second column unit wherein the anchor passes through an opening on the base unit;

wherein the anchor is secured within the ground;

wherein the anchor has a flat surface and wherein the flat surface restricts rotation of the anchor within the ground;

a motor incorporated into the at least the first column unit or the second column unit;

a vibrator apparatus incorporated into at least the first column unit or the second column unit wherein the vibrator apparatus oscillates the anchor to displace dirt in the ground and to allow the anchor to be secured into the ground; and wherein the vibrator apparatus is removably secured to a side of the vertical shaft of the anchor.

2. The anchoring system for a horizontal rig of claim 1 further comprising:

a break out mounting plate located on the top surface of the base unit.

3. The anchoring system for a horizontal rig of claim 2 wherein the break out mounting plate is at an angle of between twenty-five and fifty-five degrees with respect to the top surface of the base unit.

4. The anchoring system for a horizontal rig of claim 2 wherein the break out mounting plate has a plurality of holes for receiving securing mechanism to secure the break out mounting plate to the top of the base unit.

5. The anchoring system for a horizontal rig of claim 1 further comprising:

a light secured to at least the first column unit or the second column unit.

6. The anchoring system for a horizontal rig of claim 1 further comprising:

a pin secured to the first column unit or the second column unit wherein the pin secures the first column unit or the second column unit to a brace on the base unit.

* * * * *